US006804858B2

(12) United States Patent
Yazawa et al.

(10) Patent No.: US 6,804,858 B2
(45) Date of Patent: Oct. 19, 2004

(54) OPENING AND CLOSING MECHANISM OF HINGED PAIR OF BODIES

(75) Inventors: Hiroaki Yazawa, Aichi-ken (JP); Kiyoshi Ueda, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/253,658

(22) Filed: Sep. 25, 2002

(65) Prior Publication Data

US 2003/0056324 A1 Mar. 27, 2003

(30) Foreign Application Priority Data

Sep. 27, 2001 (JP) ..... 2001-298274

(51) Int. Cl.[7] ..... E05F 1/08
(52) U.S. Cl. ..... 16/289; 16/306
(58) Field of Search ..... 49/98, 108, 381, 49/386; 16/239, DIG. 36, 277, 280, 285, 289, 290, 295, 306, 308, 292, 50, 72, 78

(56) References Cited

U.S. PATENT DOCUMENTS 581,664 A * 4/1897 Martin et al. ..... 5/58
3,287,757 A * 11/1966 Van Noord ..... 16/291
3,643,291 A * 2/1972 Clark ..... 16/289
3,810,275 A * 5/1974 Smith ..... 16/298
4,406,379 A * 9/1983 Anderson et al. ..... 220/829
4,429,933 A * 2/1984 Sokolowski ..... 16/333
4,742,598 A * 5/1988 Bruneau ..... 16/286
4,966,403 A * 10/1990 Nordstrom ..... 296/76
5,121,521 A * 6/1992 Hagiwara et al. ..... 16/278
5,465,557 A * 11/1995 Harte ..... 53/510
6,035,490 A * 3/2000 Jones et al. ..... 16/267
6,499,189 B2 * 12/2002 Kondo et al. ..... 16/289

FOREIGN PATENT DOCUMENTS

JP A 9-166829 6/1997

* cited by examiner

*Primary Examiner*—Robert J. Sandy
*Assistant Examiner*—Andre' L. Jackson
(74) *Attorney, Agent, or Firm*—Oliff & Berridge, PLC

(57) ABSTRACT

A device comprising a pair of lower and upper bodies respectively accommodating an image scanner and a printer. The upper body is hinged at one end thereof to the lower body so that the other end thereof is allowed to move between open and close positions. A biasing mechanism is provided for biasing the upper body not to fall down toward the second body due to the weight thereof and keep it at an arbitrary position between the open and close positions. The biasing mechanism includes a spring member and applies a first biasing force to the upper body by linearly stretching the spring member. When the upper body is in the vicinity of the lower body, the biasing mechanism further generates a second biasing force to be applied to the upper body by bending the linearly stretched spring member.

26 Claims, 8 Drawing Sheets

OPENING AND CLOSING MECHANISM OF HINGED PAIR OF BODIES

BACKGROUND OF THE INVENTION

The present invention relates to a mechanism for opening and closing a first body with respect to a second body which is pivotally connected to the first body.

There has been known a device that include a lower body and an upper body pivotably mounted to the lower body via a hinge such as an image forming apparatus, the upper body of which accommodates an image scanner while the lower body a printer that forms images, on a recording medium, read by the imaging scanner from an original.

In such an image forming apparatus, a spring member is provided for biasing the upper body to pivot upon a hinge to the open position thereof. The strength of the spring member is so adjusted that the upper body manually swung by a user to the arbitrary open position thereof does not swing back toward or fall down onto the lower body due to its own weight but remains stationary there even if a user released its hand therefrom. Thus, a user can locate the upper body at any arbitrary open position with respect to the lower body.

For closing, a user manually pushes down the upper body onto the lower body. At this time, the upper body tends to apply undesirable large impact onto the lower body due to the own weight thereof. Such large impact can be prevented by increasing the strength of the spring member. However, if the strength of the spring member is increased for that purpose, the biasing force thereof becomes too large for keeping the upper body stationary at a desired open position, and the upper body springs up to a fully opened position thereof each time.

Thus, a user has been forced to pay attention every time to softly place the upper body on the lower body, which has been considerably troublesome for a user.

SUMMARY OF THE INVENTION

It is therefore an object of the invention to provide an opening and closing mechanism for a hinged pair of bodies capable of smoothly and softly closing them without a user paying attention thereto.

According to an aspect of the invention, there is provided an opening and closing mechanism that includes first and second bodies and a biasing mechanism. The first body is pivoted to the second body so that it is movable between open and close positions with respect to the second body. The biasing mechanism biases the first body to move it toward the open position thereof. The biasing mechanism includes an resilient member and exerts a first biasing force on the first body by linearly stretching the resilient member. When the first body is in the vicinity of the second body, the biasing mechanism further exerts a second biasing force on the first body by bending the linearly stretched resilient member.

By the opening and closing mechanism arranged as above, a user can smoothly move the first body from the open position toward the close position and also close the mechanism softly since the biasing mechanism increases the biasing force by bending the resilient member only when the first body is in the vicinity of the second body.

The opening and closing mechanism further includes a link-arm member connected between the first and second bodies in such a fashion that the end of the link-arm member coupled to the second body moves relative to the second body as the first body moves. The resilient member is arranged to be linearly stretched/contracted upon movement of the link-arm member, and hence upon movement of the first body. Thus, the first biasing force generated by the spring member can be varied in accordance with the location of the first body.

The link-arm member is provided with an contact portion that contacts and bends the resilient member at a side thereof when the first body is in the vicinity of the second body so that the link-arm member is pushed back by the side of the resilient member and thereby biases the first body towards the open position.

The contact portion is, for example, a protrusion formed on the link-arm member so that the more the first body approaches the close position thereof in the vicinity of the second body, the more the bending amount of the resilient member increases.

In order to increase the bending amount of the resilient member, the mechanism may further include a supporting member that is arranged to contact the resilient member from the opposite side when the protrusion contacts the resilient member.

The link-arm member may further have a portion of U-shaped section and the contact portion may be disposed therein such that it comes in contact with the resilient member received in the U-shaped section. By such an arrangement, the resilient member is prevented from sliding off from the contact portion and the generation of the second biasing force is ensured.

In some cases, the mechanism is arranged such that the first body is disposed on the second body. In such a case, the strength of the resilient member may be so adjusted that the first biasing force prevents the first body from falling down towards the second body due to its own weight and keeps the first body at an arbitrary position between the open and close position thereof.

BRIEF DESCRIPTION OF THE ACCOMPANYING DRAWINGS

Figure 3:
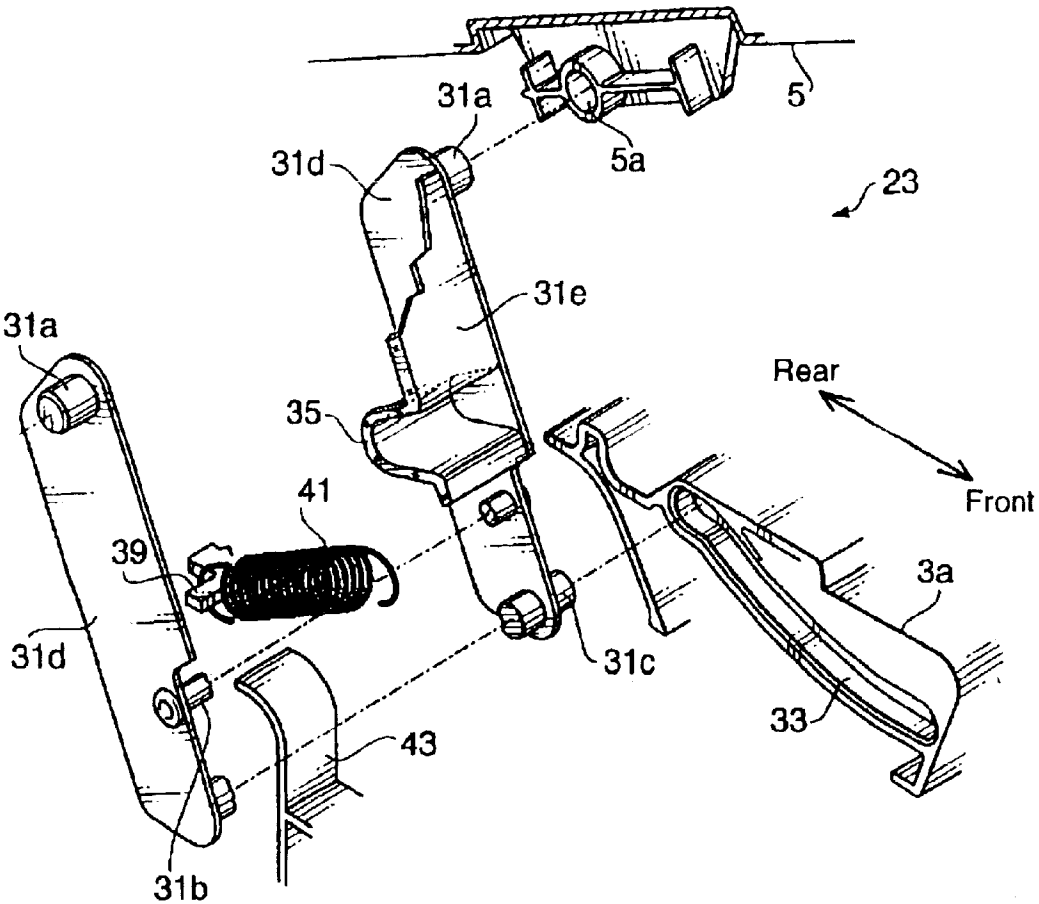
Figure 4A:
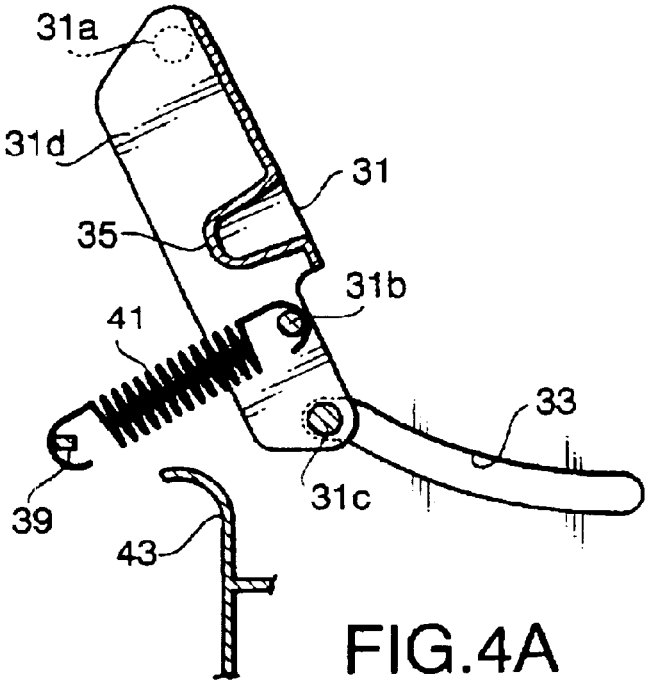
Figure 4B:
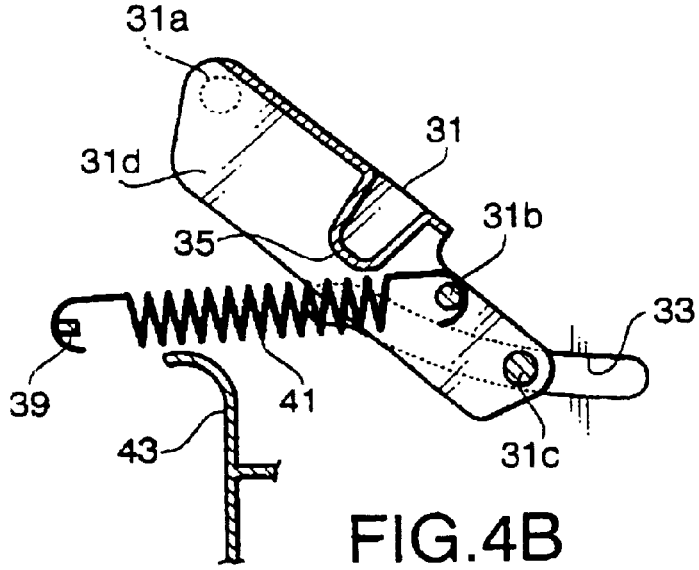
Figure 4C:
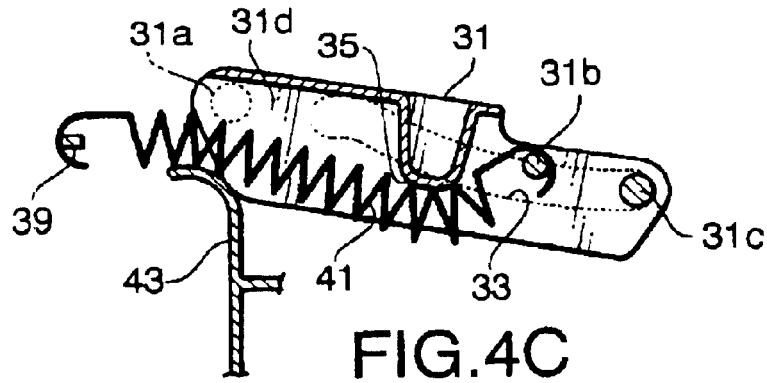
Figure 5:
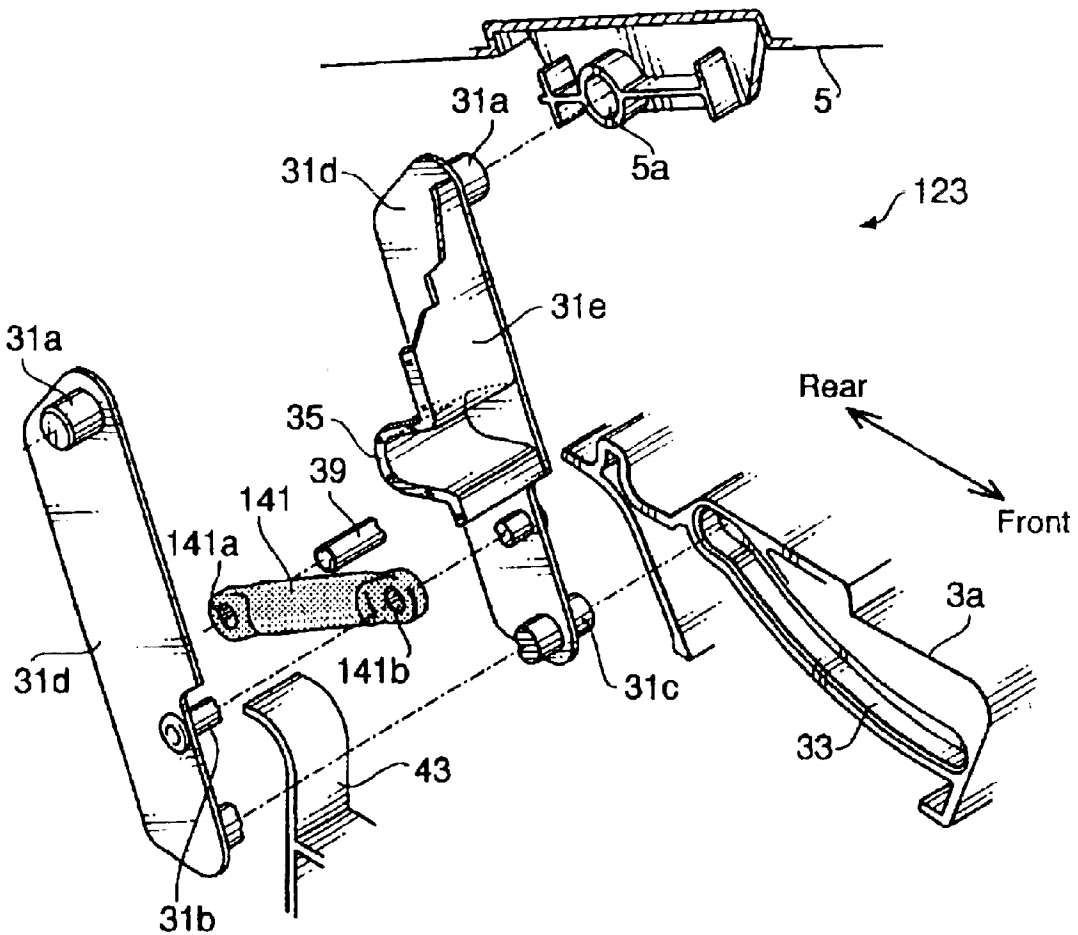
Figure 6A:
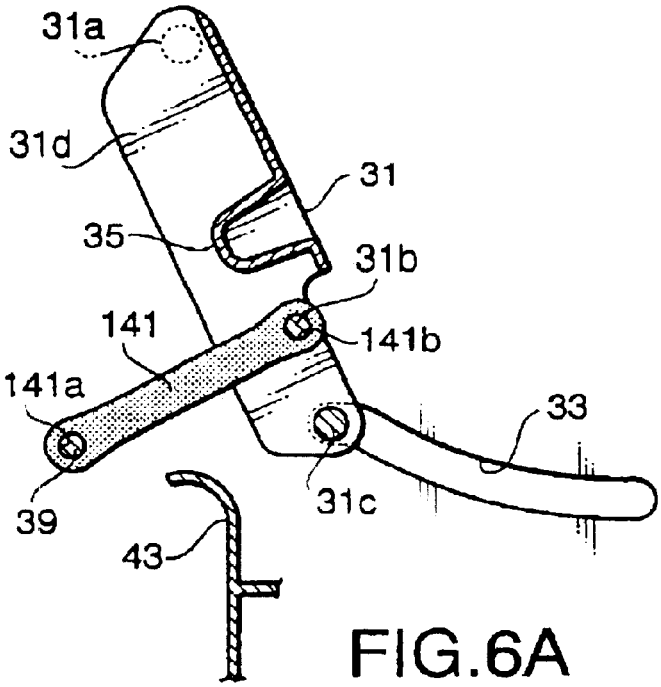
Figure 6B:
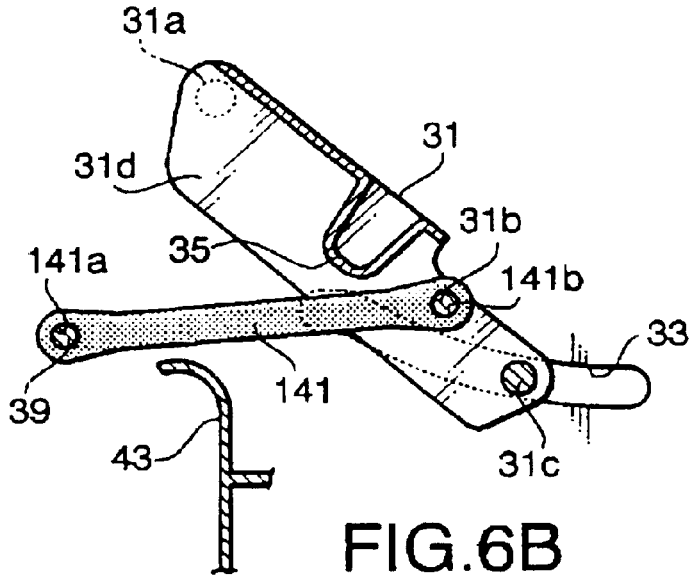
Figure 6C:
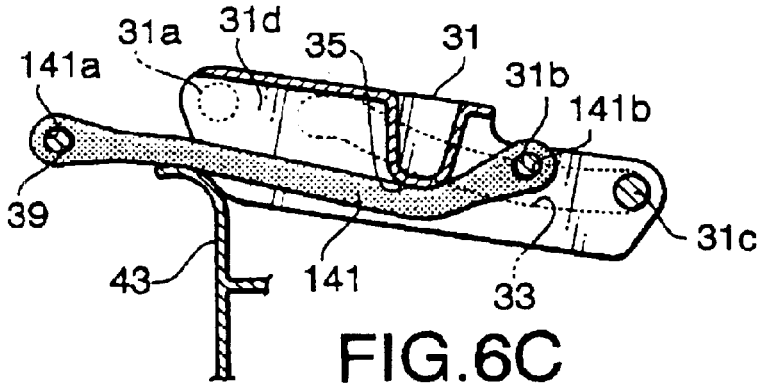

FIG. 3 schematically shows an exploded perspective view of the biasing mechanism provided to the image forming apparatus of FIG. 1; and FIGS. 4A through 4C schematically show the operation of the biasing mechanism shown in FIG. 3;

FIG. 5 schematically show an exploded perspective view of a variation of the biasing mechanism shown in FIG. 3; and FIGS. 6A through 6C schematically show the operation of the biasing mechanism shown in FIG. 5.

DETAILED DESCRIPTION OF THE EMBODIMENTS

Hereinafter, an embodiment of the present invention will be described with reference to the accompanying drawings.

Figure 1A:
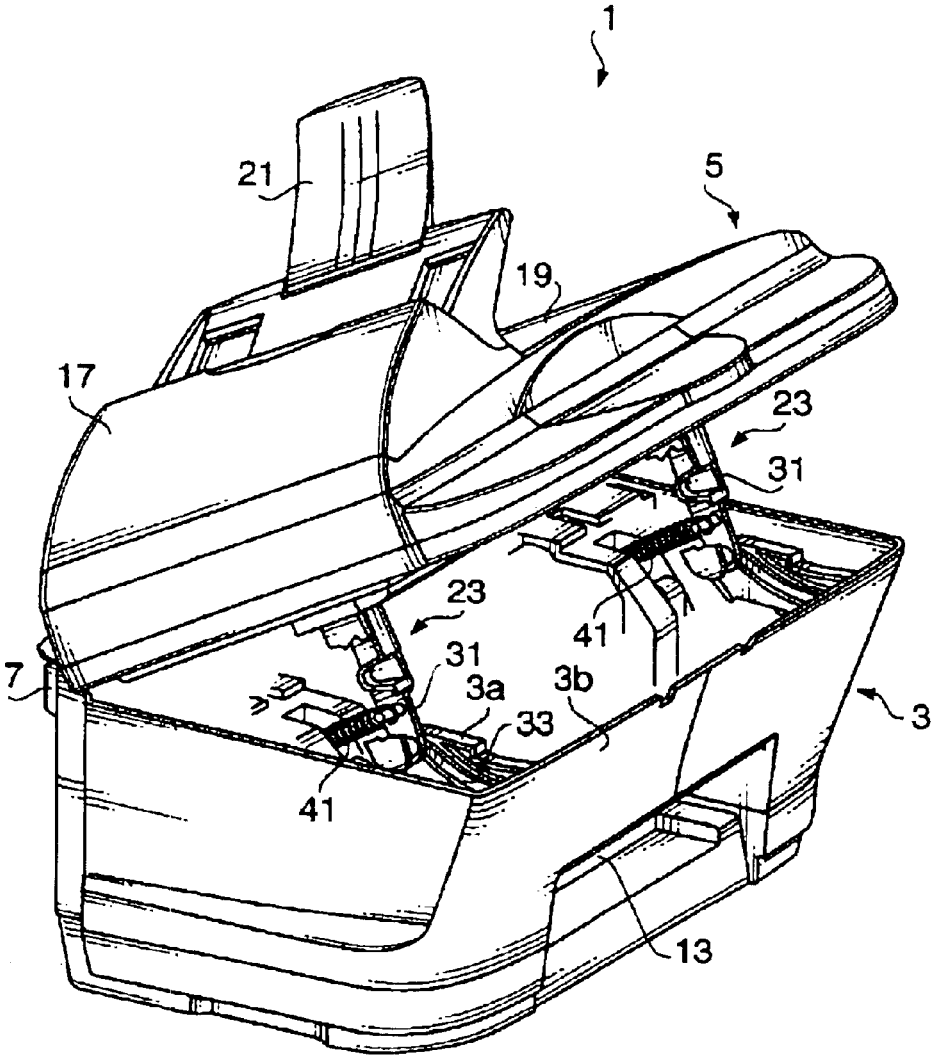
FIGS. 1A through 1C show perspective views of an image forming apparatus to which an embodiment of the invention is applied.
Figure 1B:
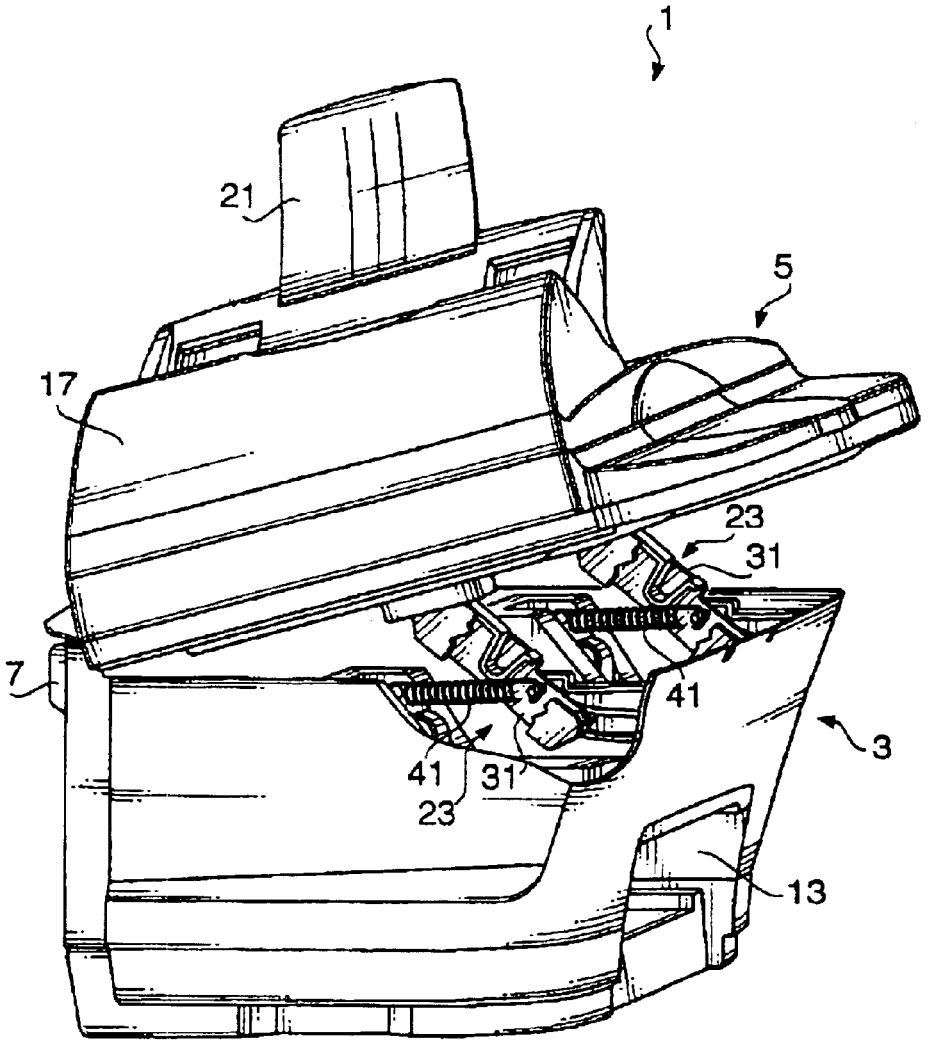
Figure 1C:
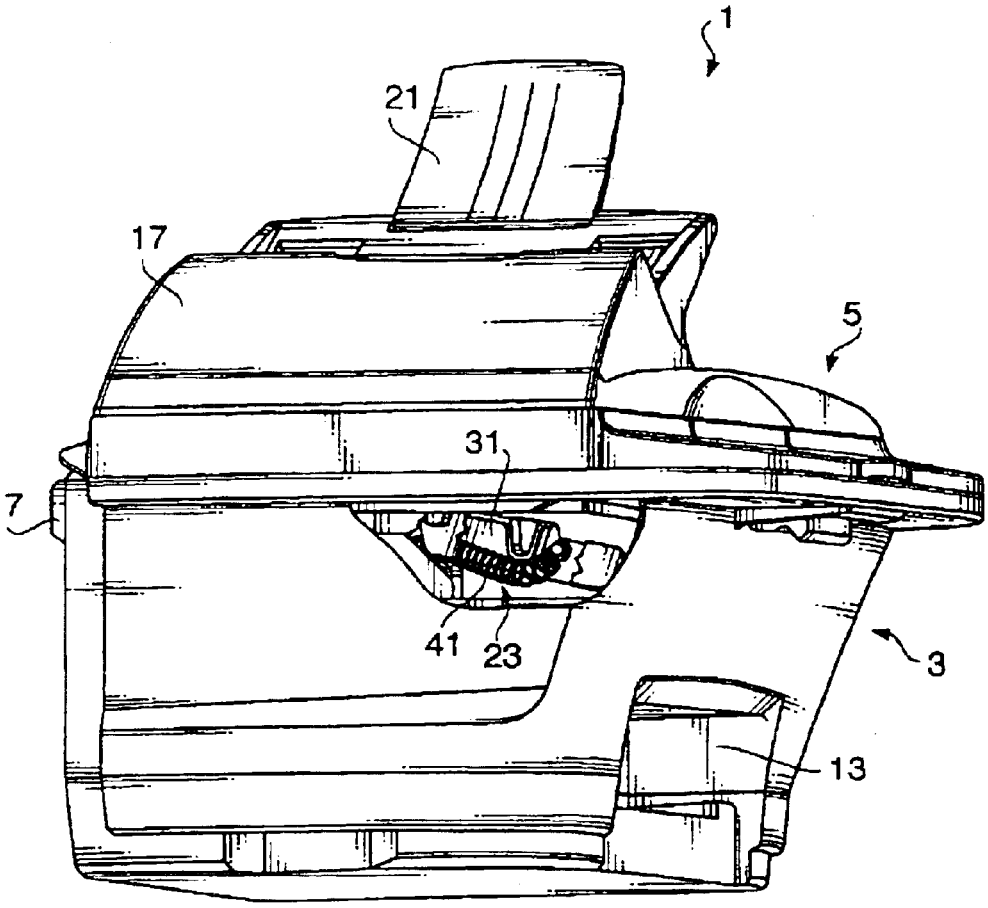

FIGS. 1A through 1C show perspective views of an image forming apparatus 1 to which an embodiment of the invention is applied, where FIG. 1A shows the image forming apparatus 1 in a fully opened state, FIG. 1B in a half opened state, and FIG. 1C in a closed state. Note that a casing of the image forming apparatus 1 is partially cut away in FIGS. 1B and 1C in order to show the mechanism inside thereof.

The image forming apparatus 1 have an upper body 5 and a lower body 3. The upper body 5 accomodates an image scanner (not shown) that reads images on an original, while the lower body accommodates an inkjet printer for printing, for example, the image read by the image scanner in the upper body 5.

The inkjet printer placed in the lower body 3 picks up a sheet from a sheet supplying tray (not shown) attached to the rear side of the image forming apparatus 1. The sheet is fed through the inkjet printer, and formed an image thereon by an inkjet print head that repetitively scans across the sheet in sheet width direction. Then, the sheet is discharged from a discharge opening 13 formed at the front of the lower body 3.

The image scanner provided to the upper body 5 is of a flat bed type having a platen glass (not shown) and a line image sensor (not shown) that moves along the platen glass to read the image on the original placed thereon.

An ADF unit 17, or an automatic document feeder unit, is also provided at the left side of the upper body 5. The ADF unit 17 picks up original documents from a document supply tray 21, sheet by sheet, feeds each document over the image sensor and discharges them on a document discharge tray 19. While the ADF unit 17 feeds the documents, the image sensor remains rest and reads the image on each document passing thereover.

The upper body 5 and the lower body 3 are pivotably connected to each other by means of a hinge 7 provided on the rear side of the image forming apparatus 1. Thus, the upper body 5 can be moved up to an open position shown in FIG. 1A, by rotating about the hinge 7, and also down to a close position shown in FIG. 1C. When the upper body 5 is moved up, as shown in FIGS. 1A and 1B, the top of the lower body 3 becomes open and allows a user to maintain the inkjet printer placed therein, such as exchanging ink cartridges or removing jammed sheets.

A pair of biasing mechanisms 23 for biasing the upper body 5 towards the open position are provided between the upper body 5 and the lower body 3 near respective sides of the image forming apparatus 1. Each biasing mechanism 23 includes an link-arm 31 connected between the upper body 5 and the lower body 3 and a spring member 41, such as a coil spring, connected to the link-arm 31 to bias it.

Figure 2:
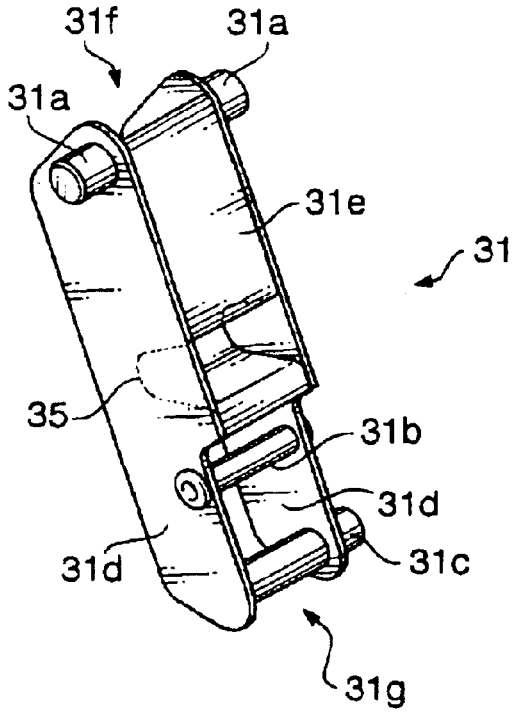
FIG. 2 is a perspective view of a link-arm utilized in a biasing mechanism provided to the image forming apparatus of FIG. 1.

FIG. 2 is a perspective view of the 1link-arm 31. The link-arm 31 have two side plates 31*d* disposed parallel to each other, and a top plate 31*e* bridging the side plates 31*d* to form a U-shaped portion. A part of the top plate 31*e* is bent to form a protrusion 35 between the two side plates 31*d* at substantially the middle of the link-arm 31 along a longitudinal direction thereof.

The link-arm 31 have first and second end portions 31*f* and 31*g*. The first end portion 31*f* is provided with a pair of cylindrical protrusions 31*a*, each formed on the outer surface of respective side plates 31*d* to extend outwardly from the link-arm 31. The second end portion 31*g* holds a cylindrical shaft 31*c* disposed perpendicularly to the side plates 31*d* with one end thereof penetrating one of the side plates 31*d* to protrude outwardly form the link-arm 31.

An engage shaft 31*b* is further provided to the link-arm 31 between the protrusion 35 and the cylindrical shaft 31*c*. The engage shaft 31*b* is located between the two side plates 31*d* with both ends thereof held by the side plates 31*d*.

FIG. 3 schematically shows an exploded perspective view of the biasing mechanism 23 of the image forming apparatus 1.

The cylindrical protrusions 31*a* formed to the first end portion 31*f* of the link-arm 31 are respectively received in a pair of bearing portion 5*a* (only one is shown) provided at the under surface of the upper body 5. In this way, the link-arm 31 is pivotably connect with the upper body 5.

The second shaft 31*c* held by the second end portion 31*g* of the link-arm 31 is slidably received, at the end thereof, in a guide groove 33 that is provided to the lower body 3. As is best seen in FIG. 1A, the guide groove 33 is formed to a inner wall 3*a* of the lower body 3, which extends perpendicularly from the front wall 3*b* of the lower body 3.

The cylindrical shaft 31*c* of the link-arm 31 slides along the guide groove 33 as the upper body moves between the open and close positions. Therefore, the inclination of the link-arm 31 with respect to a top surface of the lower body 3 changes as the upper body 5 moves.

The spring member 41 is connected between the lower body 3 and the link-arm 31 by hanging one of the hooks formed at each end thereof to the engage shaft 31*b* of the link-arm 31 and the other one to an engaging portion 39 formed to the lower body 3. The length of the spring member 41 is adjusted such that the spring member 41 is linearly stretched by the link-arm 31 irrespective the position of the link-arm 31. Accordingly, the link-arm 31 is always pulled by the spring member 41 so that it biases the upper body 5 towards the open position.

A supporting member 43 is provided below the spring member 41. The supporting member 43 contacts the spring member 41 from the underside as will be described later.

FIGS. 4A through 4C schematically show the operation of the biasing mechanism 23, where FIGS. 4A and 4C respectively show the biasing mechanism 23 with the upper body 5 at the open and close positions, while FIG. 4B shows the biasing mechanism 23 with the upper body 5 located between the open and close positions. Note that, the left and right sides of each of FIGS. 4A through 4C corresponds, respectively, to the rear and front sides of the image forming apparatus 1.

When the upper body 5 is located at the open position, the cylindrical shaft 31*c* of the link-arm 31 is located at the most rear side of the guide groove 33, as shown in FIG. 4A. In this state, the spring member 41 is slightly stretched by the link-arm 31. The biasing force applied to the upper body 5 from the biasing mechanism 23 is small but enough for preventing the upper body 5 from moving towards the close position due to its one weight.

As the upper body 5 moves down towards the close position, the link-arm 31 pivots about the cylindrical protrusions 31*a* received in the bearing portion 5*a* in a counter-clockwise direction in FIG. 4A, and the cylindrical shaft 31*c* moves along the guide groove 33 towards the front side thereof (see also FIG. 4B). The movement of the cylindrical shaft 31*c*, or the link-arm 31, gradually stretches the spring member 41 and thereby increases the biasing force of the biasing mechanism 23.

The guide groove 33 is formed in a slightly curved shape to control the increase of the stretched amount of the spring member 41 and hence the biasing force applied to the upper body 5. The guide groove 33 is formed such that the rotation moment of the upper body 5 about the hinge 7 caused by the weight thereof is canceled by the biasing force of the biasing mechanism 23 irrespective the location of the upper body 5. Accordingly, the upper body 5 remains stationary at any arbitrary position between the open and close positions thereof.

As the upper body 5 is further moved down towards the close position and comes to the vicinity of the lower body 3, as shown in FIG. 4B, the protrusion 35 of the link-arm 31 contacts the spring member 41 at a side thereof. If the upper body 5 is further moved towards the lower body 3, the protrusion 35 presses down the spring member 41. As a result, the spring member 41, already linearly expanded by the link-arm 31, bends as shown in FIG. 4C.

Note that the protrusion 35 contacts the spring member 41 between the two side plates 31*d* of the link-arm 31. The side plates 31*d* restricts the lateral movement of the spring member 41 and prevent it from sliding off from the protrusion 35.

The supporting member 43 also contacts the spring member 41 when the protrusion 35 bends the spring member 41. The supporting member 43 contacts the spring member 41 from the underside thereof to increase the bending amount of the spring member 41.

The bent spring member 41 pushes back the protrusion 35, and hence the link-arm 31, and thereby significantly increases the biasing force applied to the upper body 5 from the biasing mechanism 23. This large biasing force prevents the upper body 5 from hardly bumping against the lower body 3 and applying large impact thereto at the moment of closing it.

FIG. 5 schematically shows an exploded perspective view of an biasing mechanism 123 which is a variation of the biasing mechanism 23 shown in FIG. 3. The biasing mechanism 123 shown in FIG. 5 differs from the mechanism 23 shown in FIG. 3 in that the spring member 41 is replaced by an elongated rubber member 141 such as a rubber tube. In other points, the biasing mechanism 123 shown in FIG. 5 is arranged same as that shown in FIG. 3.

The elongated rubber member 142 has a first through hole 142*a* formed at one end portion thereof for engagement with the engaging portion 39 of the lower body 3, and a second through hole 142*b* formed at the other end portion thereof for engagement with the engaging shaft 31*b* of the link-arm 31.

FIGS. 6A through 6C schematically show the operation of the biasing mechanism 123 shown in FIG. 5. The biasing mechanism 123 shown in FIG. 5 works in the same manner as that of the biasing mechanism 23 shown in FIG. 3. That is, as the cylindrical shaft 31*c* is at the most rear side of the guide groove 33, as shown in FIG. 6A, the elongated rubber member 141 is in a slightly expanded condition so that the biasing mechanism 123 exerts a biasing force small but enough for preventing the upper body 5 from moving towards the close position. The elongated rubber member 141 is gradually stretched as the cylindrical shaft 31*c* moves along the guide groove 33, as shown in FIG. 6B, to increase the biasing force of the biasing mechanism 123. The strength of the elongated rubber member 141 is adjusted such that biasing mechanism 123 can hold the upper body 5 stationary at any arbitrary position between the open and close positions thereof.

As the cylindrical shaft 31*c* moves further along the guide groove 33, the elongated rubber member 141 is bent by the protrusion 35 of the link-arm 31, which presses down the side of the elongated rubber member 141, and the supporting member 43, which contacts the elongated rubber member from the opposite side (see FIG. 6C). The elongated rubber member 141 bent as above pushes back the link-arm 31 so that the link-arm 31 biases the upper body 5 with a greater force than before towards the open position. As a result, the biasing mechanism 123 prevents the upper body 5 from applying large impact to the lower body 3 at the moment of closing it.

It should be noted that both the spring member 41 shown in FIG. 3 and the elongated rubber member 141 shown in FIG. 5 may be replaced by any suitable resilient member that has engaging portions at both end portions thereof and generates an opposing force when a force is exerted thereto to increase the distance between the two engaging portions.

Although the present invention has been described in accordance with the embodiments shown, one of ordinary skill in the art will readily recognize that there could be variations to the embodiment and those variations would be within the spirit and scope of the present invention. For example, in some cases, the link-arm of the biasing mechanism may be connected slidably with the upper body and pivotably with the lower body, and the spring may be connected between the upper body and the link-arm. In other cases, the upper and lower bodies may accommodate devices other than the image scanner and the inkjet printer, or may even accommodate no devices.

The present disclosure relates to the subject matter contained in Japanese Patent Application No. P2001-298274, filed on Sep. 27, 2001, which is expressly incorporated herein by reference in its entirety.

What is claimed is:

1. A mechanism for biasing a first body pivotably mounted to a second body to swing toward an open position thereof from closed position, said biasing mechanism comprising:

a link-arm member connected between said first and second bodies, one end of which is pivotally coupled to said first body while the other end is relatively movably coupled to said second body, said other end of the link-arm member being arranged to move between first and second positions as said first body moves between open and close positions thereof; and resilient member secured at one end thereof to said link-arm member for biasing said link-arm member to move toward said first position thereof so that said first body is biased to move toward the open position thereof, said resilient member being arranged to be linearly stretched and/or contracted upon movement of said link-arm member, wherein an abutting portion is formed on said link-arm member that abuts and bends said resilient member when said first body is in the vicinity of said second body, and a relative positional relationship between said one end and said other end of said link-arm member is fixed when said first body moves.

2. The mechanism according to claim 1, wherein said link-arm member has a portion of U-shaped section where said abutting portion exists, said resilient member being received therein when said abutting portion abuts and bends said resilient member.

3. The mechanism according to claim 1, wherein said other end of the link-arm member is slidably received in a guide groove formed on said second body.

4. The mechanism according to claim 1, wherein said first body is disposed on said second body, and wherein the strength of said resilient member is so adjusted that said first biasing force prevents said first body from falling down toward said second body due to the weight thereof and keeps said first body at an arbitrary position between said open and close positions thereof.

5. The mechanism according to claim 1, wherein said first body houses therein an image reading device that reads an image on an original document, while said second body houses therein an image forming device that forms the image on a recording medium.

6. The mechanism according to claim 1, wherein said resilient member is a spring.

7. The mechanism according to claim 1, wherein said resilient member is an elongated rubber.

8. The mechanism according to claim 1, wherein said abutting portion is a protrusion formed on said link-arm member, and wherein, the more the first body approaches the close position thereof in the vicinity of said second body, the more the bending amount of said resilient member increases.

9. The mechanism according to claim 8, further comprises a supporting member that is arranged to contact said resilient member from the opposite side when said protrusion contacts said resilient member so as to increase the bending amount of said resilient member.

10. An opening and closing mechanism, comprising:

first and second bodies, said first body being pivoted to said second body to be movable between open and close positions with respect to said second body; and a biasing mechanism that biases said first body to move toward the open position thereof, said biasing mechanism including a resilient member and exerting a first biasing force by linearly stretching said resilient member, said biasing mechanism further including a contact member and exerting a second biasing force by said contact member contacting and bending said linearly stretched resilient member at a side thereof, said side being spaced away from ends of said resilient member, when said first body is in the vicinity of said second body.

11. The mechanism according to claim 10, wherein said resilient member is a spring.

12. The mechanism according to claim 10, wherein said resilient member is an elongated rubber.

13. The mechanism according to claim 10, wherein said biasing mechanism further includes a link-arm member connected between said first and second bodies in such a fashion that the end of said link-arm member coupled to said second body moves relative to said second body as said first body moves, said resilient member being arranged to be linearly stretched and/or contracted upon movement of said link-arm member.

14. The mechanism according to claim 13, wherein one end of said link-arm member is pivotably connected to said first body while the other end thereof is slidably received in a guide groove formed on said second body.

15. The mechanism according to claim 14, wherein one end of said resilient member is secured to said second body while the other end thereof is secured to said link-arm member around said other end of the link-arm member.

16. The mechanism according to claim 13, wherein said first body is disposed on said second body, and wherein the strength of said resilient member is so adjusted that said first biasing force prevents said first body from falling down toward said second body due to the weight thereof and keeps said first body at an arbitrary position between said open and close positions thereof.

17. The mechanism according to claim 16, wherein said first body houses therein an image reading device that reads an image on an original document, while said second body houses therein an image forming device that forms the images on a recording medium.

18. The mechanism according to claim 13, wherein said link-arm member is provided with said contact member and said link-arm member is pushed back by said side of said resilient member and thereby biases said first body towards said open position.

19. The mechanism according to claim 18, wherein said contact member is a protrusion formed on said link-arm member, and wherein, the more the first body approaches the close position thereof in the vicinity of said second body, the more the bending amount of said resilient member increases.

20. The mechanism according to claim 19, further comprising a supporting member that is arranged to contact said resilient member from the opposite side when said protrusion contacts said resilient member so as to increase the bending amount of said resilient member.

21. The mechanism according to claim 18, wherein said link-arm member has a portion of U-shaped section where said contact member exists, said resilient member being received therein when said contact member contacts and bends said resilient member.

22. A device having a pair of upper and lower bodies, one end of said upper body being hinged to said lower body so that the other end thereof is allowed to move between open and close positions, said device comprising:

a link-arm member connected between said upper and lower bodies, one end of which is pivotally coupled to said upper body while the other end is slidably received in a guide groove formed on said lower body to move between first and second positions as said other end of the upper body moves between open and close positions thereof; and an resilient member secured at one end thereof to said link-arm member for biasing said link-arm member to move toward said first position thereof so that said upper body is biased to move toward the open position thereof, said resilient member being arranged to be linearly stretched and/or contracted upon movement of said link-arm member, wherein an abutting portion is formed on said link-arm member that abuts and bends said resilient member when said upper body is in the vicinity of said lower body.

23. The device according to claim 22, wherein the strength of said resilient member is so adjusted that said upper body is prevented from falling down toward said lower body due to the weight thereof and keeps said upper body at an arbitrary position between said open and close positions thereof.

24. The device according to claim 22, wherein said upper body houses therein an image reading device that reads an image on an original document, while said lower body houses therein an image forming device that forms the images on a recording medium.

25. The device according to claim 22, wherein said resilient member is a spring.

26. The device according to claim 22, wherein said resilient member is an elongated rubber.

* * * * *